US006364792B1

(12) United States Patent
Evanochko

(10) Patent No.: US 6,364,792 B1
(45) Date of Patent: Apr. 2, 2002

(54) ICE HOCKEY STICK

(76) Inventor: Russell Evanochko, 51 Kirlystone Way, Winnipeg, Manitoba (CA), R2G 3B4

( * ) Notice: Subject to any disclaimer, the term of this patent is extended or adjusted under 35 U.S.C. 154(b) by 0 days.

(21) Appl. No.: 09/577,817

(22) Filed: May 25, 2000

Related U.S. Application Data

(60) Provisional application No. 60/136,221, filed on May 26, 1999.

(51) Int. Cl.[7] ..... A63B 59/14
(52) U.S. Cl. ..... 473/560
(58) Field of Search ..... 473/560–563, 473/568, 549; 116/110 R

(56) References Cited

U.S. PATENT DOCUMENTS

| | | | | | |
|---|---|---|---|---|---|
| 4,038,719 | A | * | 8/1977 | Bennett | 116/110 R |
| 4,351,528 | A | * | 9/1982 | Duplin | 473/560 |
| 4,553,753 | A | * | 11/1985 | Gibbons | 473/560 |
| 6,004,234 | A | * | 12/1999 | Majchrowicz | 473/560 |

FOREIGN PATENT DOCUMENTS

| | | | | |
|---|---|---|---|---|
| CA | 273438 | | 8/1927 | |
| CA | 1167876 | * | 5/1984 | 473/FOR 189 |
| CA | 1222265 | | 5/1987 | |

* cited by examiner

*Primary Examiner*—Mark S. Graham
(74) *Attorney, Agent, or Firm*—Adrian D. Battison; Michael R. Williams

(57) ABSTRACT

An ice hockey stick of the type with an elongate handle having a generally straight main portion and a blade attached to the handle at the lower end so as to project outwardly to one side of the straight line of the main portion is modified by the provision of a portion of the handle at its upper end which is curved from the straight line of the main portion such that a butt end of the curved portion is offset to one side of the line of the main portion in a direction generally opposite to that of the blade. The curved portion is short so as to be between 4 to 6 inches long and is smoothly curved to an angle of the order of 30 degrees. The curved portion joins smoothly with and has a smoothly contiguous outer surface with the shaft.

5 Claims, 3 Drawing Sheets

ICE HOCKEY STICK

This Appln claims benefit of Prov. No. 60/136,221 filed May 26, 1999.

This invention relates to an ice hockey stick of an improved shape which improves handling and control of the stick during game action.

BACKGROUND OF THE INVENTION

Conventionally ice hockey sticks have included an elongate straight shaft which attaches to a blade at the lower end projecting outwardly to one side of the shaft. The shaft is straight from the blade up to a butt end. The shaft is arranged at an angle of the order of 70 degrees relative to a generally flat bottom edge of the blade so that with the bottom edge on the ice, the player has the shaft inclined toward him or her. The shape of stick has been used widely for many years and has been accepted as the desirable optimum. Such sticks can be formed with the shaft of laminated wood or of a hollow tubular structure.

However it is believed that improvements can be made to the shape of the hockey stick to assist the user.

Canadian Patent No. 1,222,265 of Gibbons issued May 26, 1987 discloses what he calls an Angular Hockey Stick Grip which attaches to the end of a conventional hockey stick. The angular grip of Gibbons has a hollow tubular portion or sleeve which slides over the end of the conventional stick and includes a straight hand grip portion canted relative to the tubular portion and thus to the length of the straight shaft at a fixed angle of the order of 45 degrees. This arrangement forms a rib around the shaft at the junction between the shaft and the sleeve which interferes with the movement of the player's hand along the shaft during play. Also the fixed straight handle portion provides only a single angle which cannot adjust to the wrist, hand or arm angle of the player during play therefore the grip does not conform to the contours of the player's hand. The grip is molded from a plastics material so that it makes the butt end of the stick bulky so the feeling of holding a real stick is lost. There is a sharp change in direction at the junction between the handle portion and the main part of the shaft. This arrangement has not been adopted in practice.

Canadian patent 273,438 of McKenzie issued Aug. 30, 1927 discloses a stick in which there is a change of direction approximately half way up the shaft so that the part of the stick held by the hands of the player has an imaginary extrapolation intersecting the blade approximately at its mid point. This arrangement has not been adopted in practice.

SUMMARY OF THE INVENTION

It is one object of the present invention, therefore to provide an improved ice hockey stick.

According to one aspect of the invention there is provided an ice hockey stick comprising:

an elongate handle having a generally straight main shaft portion extending from a lower end toward the upper end and defining a generally straight line of the main portion;

a blade on the handle at the lower end so as to project outwardly to one side of the straight line, the blade having a bottom edge arranged at an angle of less than 90 degrees to the shaft portion;

the handle having a curved portion of the handle at its upper end which is continuously and smoothly curved from the straight line of the main shaft portion such that a butt end of the curved portion is offset to one side of the line of the main portion in a direction generally opposite to that of the blade.

Preferably an imaginary line from the butt end to a junction between the curved portion and the main portion defines an angle less than 45 degrees to the straight line.

Preferably the angle is of the order of 30 degrees.

Preferably the junction between the curved portion and the main shaft portion is smooth allowing a hand of the player to smoothly slide from one to the other.

Preferably the curved portion has an outer surface which is flush with an outer surface of the main shaft portion so as to avoid shoulders on the outside surface of the stick which would interfere with smooth sliding of the hand of the player along the handle from the butt end to the main shaft portion.

Preferably the curved portion has a length less than 9 inches.

Preferably the curved portion has a length lying in the range 4 to 6 inches.

Preferably the main shaft portion comprises a hollow tube and wherein the curved portion comprises a handle portion and a stub shaft portion where the stub shaft portion can be inserted into the hollow tube and the handle portion has an outer surface which is smoothly contiguous with an outer surface of the shaft portion.

Thus improvements can be made to the shape of the hockey stick to assist the user. The butt end of the hockey stick can be curved to give the user a comfortable feel and a natural feel. The bent end will give a better range of movement with the wrist at a more related position and a larger control area with more blade on the ice which leads to better control and feel of the puck. The bent end allows the player to utilise the same shot and technique as the conventional stick and allows the player to vary his or her lie of the blade to a more effective position. It also allows the player to put more pressure on the shaft and butt end to get more efficient use out of the entire stick. With added leverage at the butt end, it causes the shaft to twist, as well as flex in the middle, giving the player added power and spin on the puck than with the conventional stick. Due to the added twist in the shaft the puck stays on the blade a fraction longer giving the player more control of the shot.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
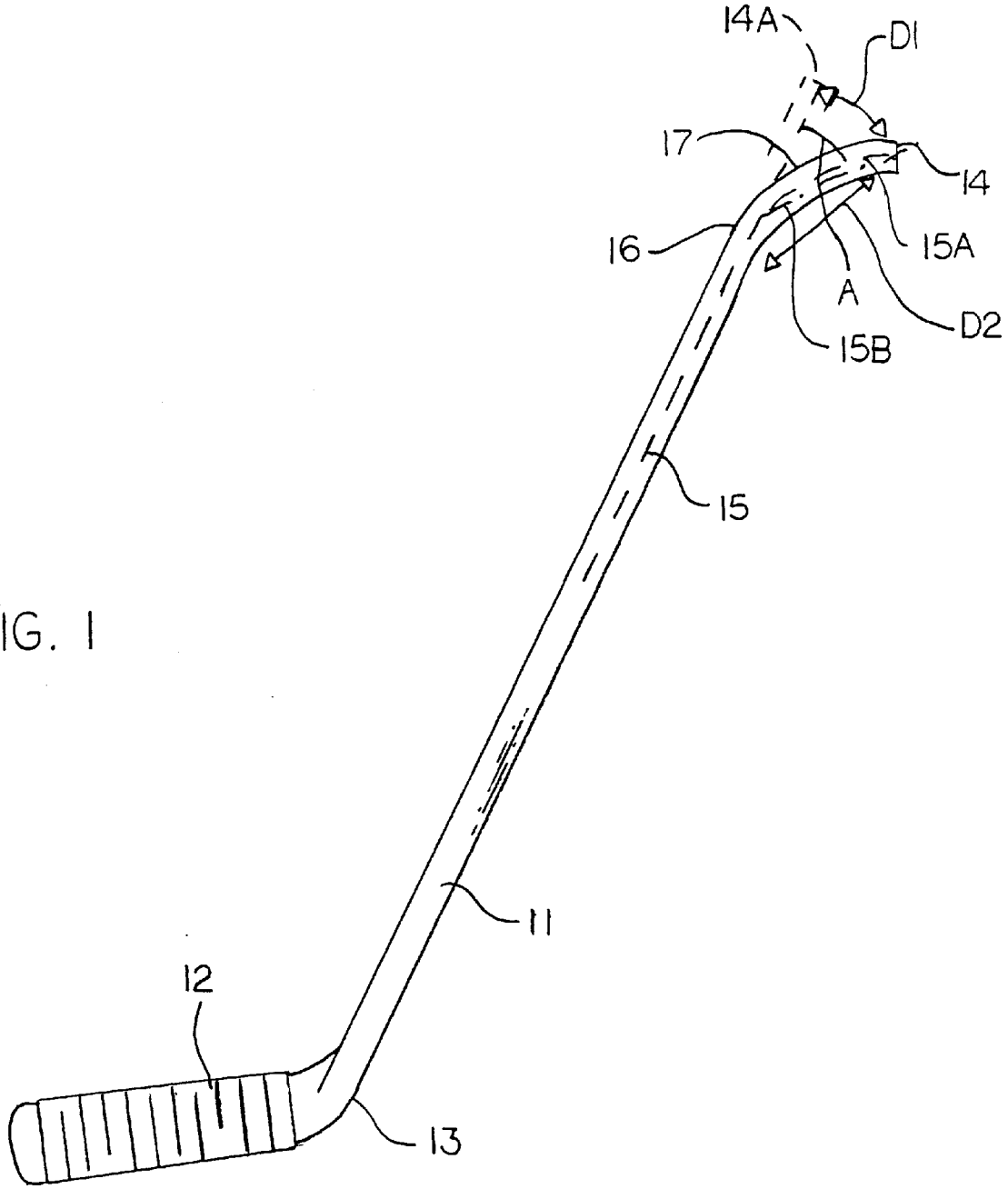
FIG. 1 is a side elevational view of a hockey stick according to the present invention.

In FIG. 1 is shown a hockey stick 10 having a shaft 11 and a blade 12. The blades project outwardly to one side of the shaft and the structure is generally planar that is lying in one common plane although the blade may be bent to achieve improved puck handling abilities.

The shaft 11 comprises a main body portion extending from a bottom end 13 toward an upper end or butt end 14. The main body portion has a straight longitudinal axis 15 and the main body portion terminates at an upper end 16 which is intermediate the length of the shaft between the butt end and the lower end.

In this arrangement an upper part 17 of the hockey stick commencing at the junction 16 is curved outwardly to one side of the main portion so that the butt end 14 is displaced to the one side relative to an imaginary end 14A of the conventional straight shaft. The amount of displacement is indicated at D1 and the length of the curved portion is indicated at D2. An angle between the butt end 14 and the imaginary butt end 14A is indicated at A.

The portion 17 is smoothly curved so that the curve is continuous from the junction 16 through to the butt end 14. Thus a center line of the shaft extends from the centre line 15 of the main portion and curves outwardly as indicated at 15A. The angle A is indicated as being between the center line 15 and the chain dot line 15B which is straight line joining the butt end 14 to the imaginary centre line.

Figure 2:
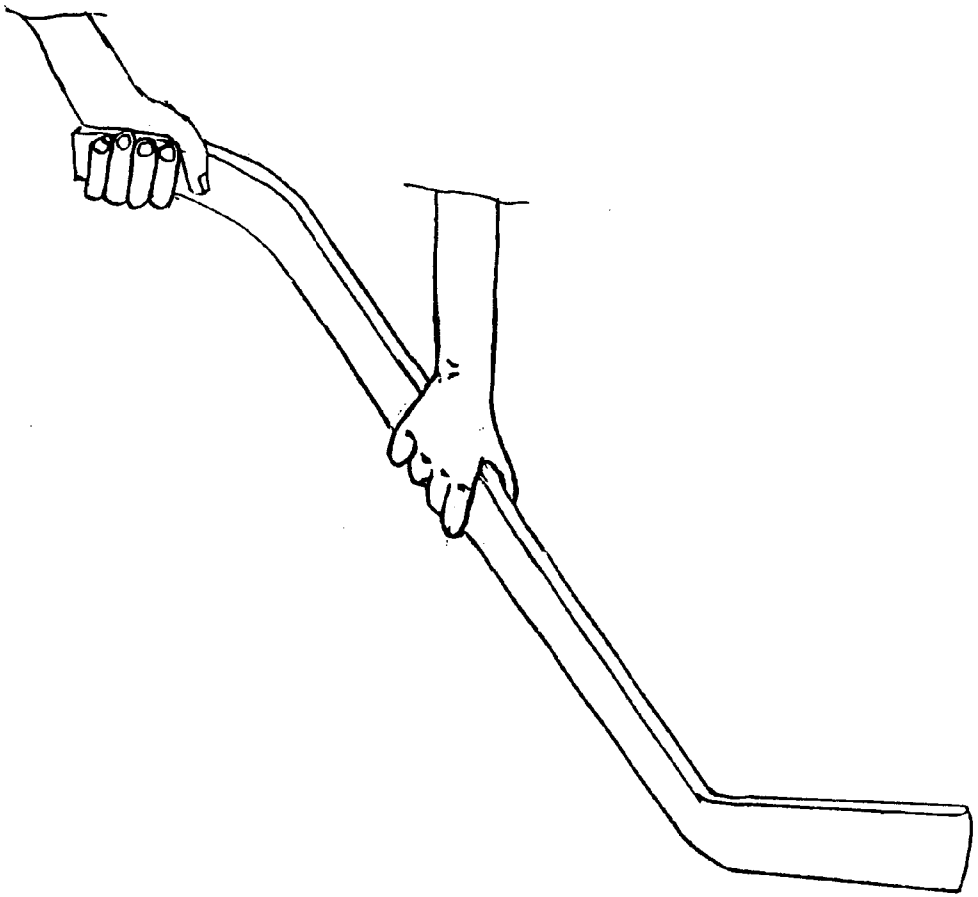
FIG. 2 is an isometric view of the stick of FIG. 1 showing the stick in use.

The direction of projection of the portion is directly opposite to the blade so that the whole stick is substantially planar as indicated in FIG. 2.

The length of the portion 17 lies preferably in the range 4 to 6 inches and is certainly less than nine inches so that it provides a part of the shaft which is available for grasping by the upper hand that is a left hand or righthanded player with a lower hand, or right hand of the righthanded player, being placed on the straight portion of the shaft as shown in FIG. 2. Thus the length of the portion 17 is just sufficient so that it receives the whole of the hand of the user and the hand with a hockey glove is generally of the order of four inches in width.

The amount of curvature is such that the butt 14 is offset from the imaginary butt 14A by a distance of the order of 1 to 2 inches and preferably of the 1.75 inches. These lengths generate an angle A which is less than 45° and preferably at the order of 30°. The angle can be custom bent to accustom to a players personal preference.

Figure 3:
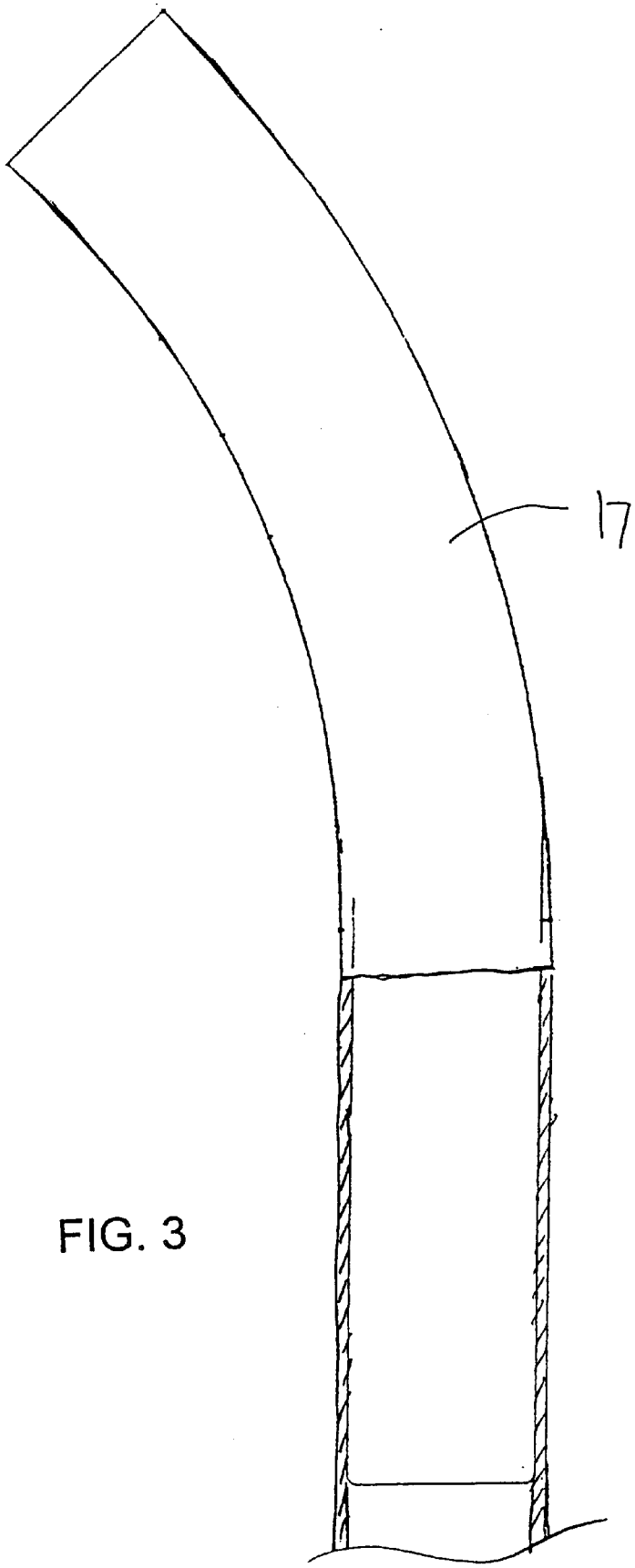
FIG. 3 is a side elevational view of the stick of FIG. 1 showing the upper part only on an enlarged scale.

The technique for manufacturing the curved portion can vary in accordance with conventional manufacturing techniques. Thus the shaft may be formed from a laminated wood in conventional manner in which case the curved portion is also defined by a curved section of the laminates which lie at right angles to the curvature. Alternatively as shown in FIG. 3, the curved portion can be manufactured as a separate insert which is attached to a conventional straight shaft for example by a tubular section which receives an upper end of the shaft. With one piece construction twist of the curved portion causes twist down the whole shaft of the stick causing more power and control. The curved portion can vary in angles for the different styles or grips of the players.

The curvature or bending of the portion 17 to one side of the shaft has been found by the inventor to provide an improved ability for the player to control the stick in that the left hand or upper hand is arranged at a better angle for the wrist of the player. In addition, tendency of the shaft to twist in the hands of the player about the central axis 15 is reduced in view of the fact that the player can more readily grasp the portion 17 and prevent the twisting of that portion around the axis 15 in view of the displacement of the butt 14 away from the axis 15.

The present hockey stick as described above has the following advantages:

More natural feel.

More comfortable grip.

Better range of movement with wrist at a more related position.

Lie of blade has more range.

Larger control area with more blade on the ice.

Better control of puck.

Better feel for the puck.

Increases the efficiency, strength and range of wrist use (grip hand).

With wrist at a more comfortable angle, more pressure can be put on it (butt of the stick).

With the new butt end, more leverage can be applied, thus getting more use out of the entire stick, making it more effective. With the new end, it allows more flexibility and more wrist rotation. (More rotation means more momentum to shaft and blade which means harder, faster shots.). On a traditional shaft during shots, the bend is in the middle of the shaft where most pressure is applied. This causes a whip-like action on follow through which causes the puck to leave at moment of impact. This can cause control problems, depending on the lie of blade at impact. More power is gained from leverage on the curved portion and the extra twist and bend in the stick.

The curved portion is continuously curved so that the palm of the players hand can be positioned differently for a different feel on the curved portion varying the hand, wrist and arm angles during play making the stick versatile. The continuously curved portion increases safety for the players since the butt end of the stick is not as blunt and is not at a sharp angle so the effects from spearing are minimised.

The new butt allows the player to use the same shot and technique, but it also allows the player to vary his lie of the blade to a more effective position. It also allows the player the ability to put more pressure on the shaft and butt end (leverage) to get more efficient use out of the entire stick. With the added leverage at butt end, it causes the shaft to twist, as well as flex in the middle, giving the player added power and spin on the puck. Because of the added twist in the shaft, the puck stays on the blade a fraction longer, giving the player more control of the shot.

The handle portion can be made of solid wood, laminated wood, fiberglass or composite material, metal, plastics or types of, any material solid or light enough to withstand breaking or de-laminating under pressure. It can also be used in a one piece construction of any of the combinations. It can also be adapted to solid wooden shaft by cutting the shaft to desired length and tapering the shaft two or three inches to accept a metal or composite, or plastic tube which fits over the shaft which is glued or secured in place, and then adding the new butt end at the top.

As shown in FIG. 3, it can be used as an insert (butt end) on metal or fiberglass composite shafts where the shaft is hollow and will receive a stub shaft portion of the new butt end. Such tubes are usually rectangular so that the outer surface of the curved portion is also rectangular in cross-section and is arranged to be smoothly contiguous with the end of the handle to allow the hand of the player to slide through the junction and along either the shaft or the curved portion as required by the player without interference by any abutment or shoulder. This allows the player to position his hand at the best position to get the hand and wrist at the preferred angle for play at any time.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. An ice hockey stick comprising:

an elongate handle having a generally straight main shaft portion extending from a lower end toward the upper end and defining a generally straight line of the main shaft portion;

a blade on the handle at the lower end so as to project outwardly to one side of the straight line, the blade having a bottom edge arranged at an angle of less than 90 degrees to the main shaft portion;

the handle having a curved portion of the handle at its upper end which is continuously and smoothly curved from the straight line of the main shaft portion to a butt end of the curved portion;

the curved potion being smoothly and contiguously connected with the main shaft portion;

the butt end of the curved portion being offset to one side of the line of the main portion in a direction generally opposite to that of the blade;

the curved portion and the main shaft portion being arranged to allow the hand of the player to slide through the junction and along the main shaft portion and the curved portion as required by the player without interference from any abutment, shoulder and discontinuity in the curvature.

2. The ice hockey stick according to claim 1 wherein an imaginary line from the butt end to a junction between the curved portion and the main shaft portion defines an angle less than 45 degrees to the straight line.

3. The ice hockey stick according to claim 2 wherein the angle is of the order of 30 degrees.

4. The ice hockey stick according to claim 1 wherein the curved portion has a length less than 9 inches.

5. The ice hockey stick according to claim 1 wherein the curved portion has a length lying in the range 4 to 6 inches.

* * * * *